US005263787A

United States Patent [19]

Wilcox et al.

[11] Patent Number: 5,263,787

[45] Date of Patent: Nov. 23, 1993

[54] INVERTED CAP FOR CRAFT PAINT APPLICATORS

[75] Inventors: Reed N. Wilcox, Littleton; Richard L. George, Englewood; William K. Thiess, Aurora, all of Colo.

[73] Assignee: The Flagship Group, Inc., Engelwood, Colo.

[21] Appl. No.: 888,552

[22] Filed: May 22, 1992

[51] Int. Cl.[5] ..... B43K 9/00

[52] U.S. Cl. ..... 401/131; 215/353; 220/290; 222/105; 401/262

[58] Field of Search ..... 401/131, 262; 215/353; 220/290; 248/109; 222/105, 562, 551

[56] References Cited

U.S. PATENT DOCUMENTS

| | | | |
|---|---|---|---|
| 1,590,636 | 6/1926 | McManus et al. | 222/105 |
| 2,076,826 | 4/1937 | Reinsberg | 222/105 |
| 2,084,568 | 6/1937 | White | 222/105 |
| 2,765,950 | 10/1956 | Wheeler | 220/290 |
| 2,907,496 | 10/1959 | Carstensen | 222/562 X |
| 2,941,694 | 6/1960 | Harman | 222/562 X |
| 3,106,742 | 10/1963 | Schultz et al. | 401/212 |
| 3,192,555 | 7/1965 | Nyden | 15/592 |
| 3,236,417 | 2/1966 | Linton | 401/262 X |
| 3,317,069 | 5/1967 | Chin | 215/353 |
| 3,945,381 | 3/1976 | Silver | 128/249 |
| 4,002,182 | 1/1977 | Michel | 401/262 X |
| 4,150,761 | 4/1979 | Collins | 215/228 |
| 4,230,230 | 10/1980 | Mumford | 215/321 |
| 4,273,247 | 6/1981 | Earls | 215/228 |
| 4,722,459 | 2/1988 | Goncalves | 401/262 X |

FOREIGN PATENT DOCUMENTS

| | | | |
|---|---|---|---|
| 330765 | 12/1920 | Fed. Rep. of Germany | 401/131 |
| 2161237 | 6/1973 | Fed. Rep. of Germany | 222/105 |
| 1323528 | 3/1963 | France | 401/262 |
| 1574032 | 7/1969 | France | 222/105 |
| 416164 | 11/1946 | Italy | 401/131 |
| 629328 | 12/1961 | Italy . | |
| 165195 | 10/1958 | Switzerland | 401/262 |
| 887894 | 1/1962 | United Kingdom | 401/131 |

*Primary Examiner*—Steven A. Bratlie

*Attorney, Agent, or Firm*—Dorr, Cason, Sloan & Peterson

[57] ABSTRACT

A holder having a sealing cap portion for craft paint applicators. The holder includes a lower base portion with an interior cavity formed in the upper portion of the holder. A threaded portion is formed therein for mating engagement with a threaded portion on the applicator bottle. The interior cavity terminates in an end wall portion that seals the dispensing end of the applicator tip from air circulation and from leakage. The applicator is inserted in the interior cavity of the holder and twisted to lock the applicator tip in the holder so the applicator tip is sealed within the holder. This allows the base portion of the holder to support the applicator in a inverted position. Since the applicator is inverted, craft paint is always in fluid contact with the inner surfaces of the applicator tip. This prevents the craft paint from drying and clogging the applicator tip and also keeps any air in the applicator at the end of the applicator opposing the applicator tip to minimize the formation of air bubbles in the flow of the craft paint.

2 Claims, 3 Drawing Sheets

INVERTED CAP FOR CRAFT PAINT APPLICATORS

BACKGROUND OF THE INVENTION

1. Related Inventions

| TITLE | Ser. No. | FILING DATE |
|---|---|---|
| Fine Point Tip Applicator For Craft Paint | 07/888,055 | May 22, 1992 |
| Self Adjusting Soft Seal Cap For Fine Point Craft Paint Applicators | 07/888,059 | May 22, 1992 |
| Craft Paint For Forming High Resolution Designs | 07/887,699 | May 22, 1992 |
| Craft Paint System For Forming Fine Designs and Method Therefor | 07/887,289 | May 22, 1992 |

2. Field of the Invention

The present invention relates to the field of craft paint applicators and particularly to the field of caps for craft paint applicators.

3. Statement of the Problem

There is great interest in forming stylized decorative designs on surfaces, such as fabrics, wood, leather, painted, and vinyl surfaces as well as other surfaces, through the use of craft paints. Craft pants are widely used since a colorful design can be quickly created on a variety of surfaces. In craft painting, the design is not necessarily limited to a pattern since normally the design is painted by free hand style. The design can thus be creative and colorful. Alternatively, craft painting can be applied by the use of patterns to create a particular design. Typically, these designs require a craft paint applicator, particularly for use in creating stylized decorative designs on a surface by applying a plurality of discrete beads in differing colors to form an image having a high degree of resolution and color saturation. Each of these beads include a uniform homogenous shape to form a dimensional, textured appearance. The term "uniform" as used herein refers to beads having a regular size and a smooth rounded substantially spherical shape.

One such design 10 is illustrated in FIG. 1. Design 10 is created on surface 12, such as fabric, by a plurality of beads 14 of differing colors. Each of the beads 14 has the uniform homogenous shape discussed above, which is shown in FIG. 2; the beads form a color dot matrix image having a high degree of resolution. A fine tip applicator tip is required in order to create the beads necessary to form such an image.

Several problems have occurred in forming these finely detailed designs due to the conventional applicators of the prior art craft paints. The conventional craft paint applicators are always maintained upright when stored and not actually in use. Craft paint may drain out of the applicator tip if the applicator is not maintained upright. This creates a mess on and around the applicator tip. As shown in FIG. 3, conventional craft paint applicator 30 is stored vertically upright. Even during the craft painting process, the applicator bottle 32 is maintained vertically with the applicator tip 38 upright when not actually in use. This causes the craft paint 34 to flow downward away from applicator tip 38 thus creating an air pocket 36 between applicator tip 38 and the remaining craft paint 34. The craft paint that remains on the sides of applicator tip 38 due to surface friction tends to dry which then clogs (fully or partially) the applicator tip 38. Then, as applicator 30 is tilted for use, as shown in FIG. 4, craft paint 34 flows downward as indicated by the arrows 37 through the air pocket and against applicator tip 38. The air pocket **36*a* is reformed at the upward end of the tilted applicator 30 which creates air bubbles 39 dispersed through craft paint 34. Some of the air bubbles 39*a* may be carried through the craft paint out of applicator tip 38** creating an undesirable "sputtering", "spitting" or "popping" of the craft paint onto the application surface as discussed below.

In creating the beads 14 for color dot matrix design 10, it is essential that air bubbles 39 do not disrupt the flow of craft paint and that paint in the dispensing end of the applicator tip does not become dry. The movement of the fluid craft paint and air creates problems in the application of craft paint, particularly in creating finely-detailed designs requiring a fine tip applicator. The movement of the liquid craft paint and the air pocket within the applicator forms air bubbles in the craft paint as the applicator bottle is tilted vertically in either direction. As the craft paint is applied, the air bubbles formed in the craft paint cause "spitting" and "burping" to occur in the flow of craft paint. This causes the craft paint to splatter on the application surface. The air bubbles can also cause the flow to "pop", i.e., create an air bubble which bursts on contact with the application surface so as to create a bead with a crater in it. These effects cause the craft paint to be applied incorrectly and disrupt the entire design. The formation of air bubbles is particularly a problem in fine applications such as beads. The beads are formed in non-uniform, irregular shapes and sizes due to the air bubbles.

Experienced craft paint users will wait for the air bubbles to move upwards through the craft paint after inversion of the bottle to avoid this problem. However, this consumes time and can lead to frustration on the part of the user in repeatedly having to wait for the paint to be ready for use.

The accumulation of air inside applicator bottle and applicator tip forming an air pocket also tends to dry the craft paint within the applicator tip. The dried paint restricts the flow of the craft paint out of the applicator tip as well as introduce turbulence in the flow due to the obstructions formed by the dried paint. This causes the flow to be irregular and much more difficult to control. The restricted flow also requires increased hand pressure to force the craft paint through the restricted applicator tip which can result in the clogged flow breaking free and dispensing too much paint, thus creating a mess on the application surface. The increased hand pressure can lead to fatigue as well which reduces the enjoyment of creating a design. These problems are especially critical in fine tip applicators having much smaller orifices necessary for detailed applications.

In order to prevent the craft paint from drying on and within an applicator tip, many applicators secure a cap over the applicator tip. A problem with these conventional craft paint applicators occurs from inadequate sealing of the dispensing end of the craft paint applicator tip by the cap. Inadequate sealing of the dispensing end of the applicator tip will allow air to circulate within the applicator tip causing craft paint to dry within the applicator tip.

The conventional craft paint applicators require a two-handed operation to place a cap on the applicator tip even for temporary storage. The user must use one hand to hold the applicator bottle while securing a cap on the applicator bottle with the other hand. This can be awkward when actively creating a design as well as occasionally causing the user's hands to be covered with paint from the cap when alternating use with more than one applicator.

The craft paint applicators of the prior art are easily knocked over which can lead to spillage as well as problems in storing these applicators. The shape of the applicator bottles, particularly oval-shaped bottles which are often preferred due to the ease of use, are inherently unstable. This is particularly a problem when there are several applicators in use to create different color schemes since, for efficiency, the caps of the applicators may remain removed throughout the creative process.

Thus, a problem exists in that, at present, there is no craft paint applicator that minimizes the formation of air bubbles in the craft paint as well as drying of the craft paint within the applicator tip. This problem of drying of the craft paint within the applicator tip becomes especially critical in the application of craft paint for finely detailed designs. In order to provide high degree of resolution to the appearance of the painted design, particularly when discrete beads of the craft paint are applied, the craft paint must be applied in a uniform fashion. Typically, finely detailed designs require the use of an applicator having a fine tip which are particularly affected by the problems with air bubbles and dried paint. Other problems with the prior craft paint applicators include the lack of a ready-to-use applicator and stability of these applicators. All of these problems tend to lessen the enjoyment of creating designs by craft paint application.

4. Solution to the Problem

The present invention solves this problem and others by providing an inverted cap, which also serves as a holder for craft paint applicator bottles, which minimizes the formation of air bubbles in the craft paint to enhance the creation of designs having a high degree of resolution. The applicator is sold, used, and stored with the cap inverted and with the applicator tip directed downward into the cap.

The applicator of the present invention includes a cap which minimizes drying of craft paint within the applicator tip.

The cap of the applicator effectively seals the dispensing end of the applicator tip to minimize air drying within the applicator tip and leakage out of the applicator tip.

The cap of the present invention also serves as a holder which provides a stable platform for storing and repeated use of the applicator. The cap is circular in shape having a diameter equal to the largest diameter of the oval shaped applicator so as to be stable at all positions of application insertion.

The applicator holder of the present invention maintains the applicator in a ready-to-use, inverted position to eliminate formation of air pockets and air bubbles in the craft paint.

The applicator holder of the present invention holds the applicator in an inverted ready position for immediate use without the need to wait for the craft paint to flow to the applicator tip or to minimize air bubbles in the craft paint during initial and repeated use.

These and other features of the present invention will be evident in the ensuing drawings and description.

SUMMARY OF THE INVENTION

The present invention provides a holder having a sealing cap portion for craft paint applicators. The holder includes a frusto-conical exterior portion having a lower base portion of substantially the same diameter as the largest diameter of the applicator bottle. An interior cavity is formed in the upper portion of the holder. A threaded portion is formed therein for mating engagement with a threaded portion on the applicator bottle. The threaded portions are designed to provide a quick "twist-lock" engagement between the holder and the applicator tip.

The interior cavity further includes an abutment shoulder which is engaged by an abutment shoulder on the applicator tip to form a seal to limit air circulation around the dispensing end of the applicator tip. The interior cavity terminates in an end wall portion that is spaced the effective length of the applicator tip from the abutment shoulder. This allows the end wall portion to seal the dispensing end of the applicator tip from air circulation and from leakage.

The applicator is inserted in the interior cavity of the holder and twisted to lock the applicator tip in the holder so the applicator tip is sealed within the holder. This allows the base portion of the holder to support the applicator in an inverted position. Since the applicator is always inverted, craft paint is always in fluid contact with the inner surfaces of the applicator tip. This prevents the craft paint from drying and clogging the applicator tip. The inverted position also keeps any air in the applicator at the end of the applicator opposing the applicator tip to minimize the formation of air bubbles in the flow of the craft paint.

An additional benefit is that the inverted applicator is always in a ready-to-use position. There is no need to wait for the paint to flow from the opposing end to the applicator tip. This allows the applicator to be used in a quick and efficient manner.

The holder can also be used to support the applicator in a temporary working position. The applicator is inserted into the interior cavity of the holder so that only the initial parts of the threaded portions engage one another. This allows the applicator to be handled with only one hand both during use and during temporary work position.

The holder of the present invention provides a stable holder for a craft paint applicator that minimizes air bubbles in craft paint flow and drying of the craft paint within the applicator tip. The holder of the present invention greatly enhances the efficiency and enjoyment of creating stylized designs through the application of craft paint.

DETAILED DESCRIPTION OF A PREFERRED EMBODIMENT

1. Overview

Figure 1:
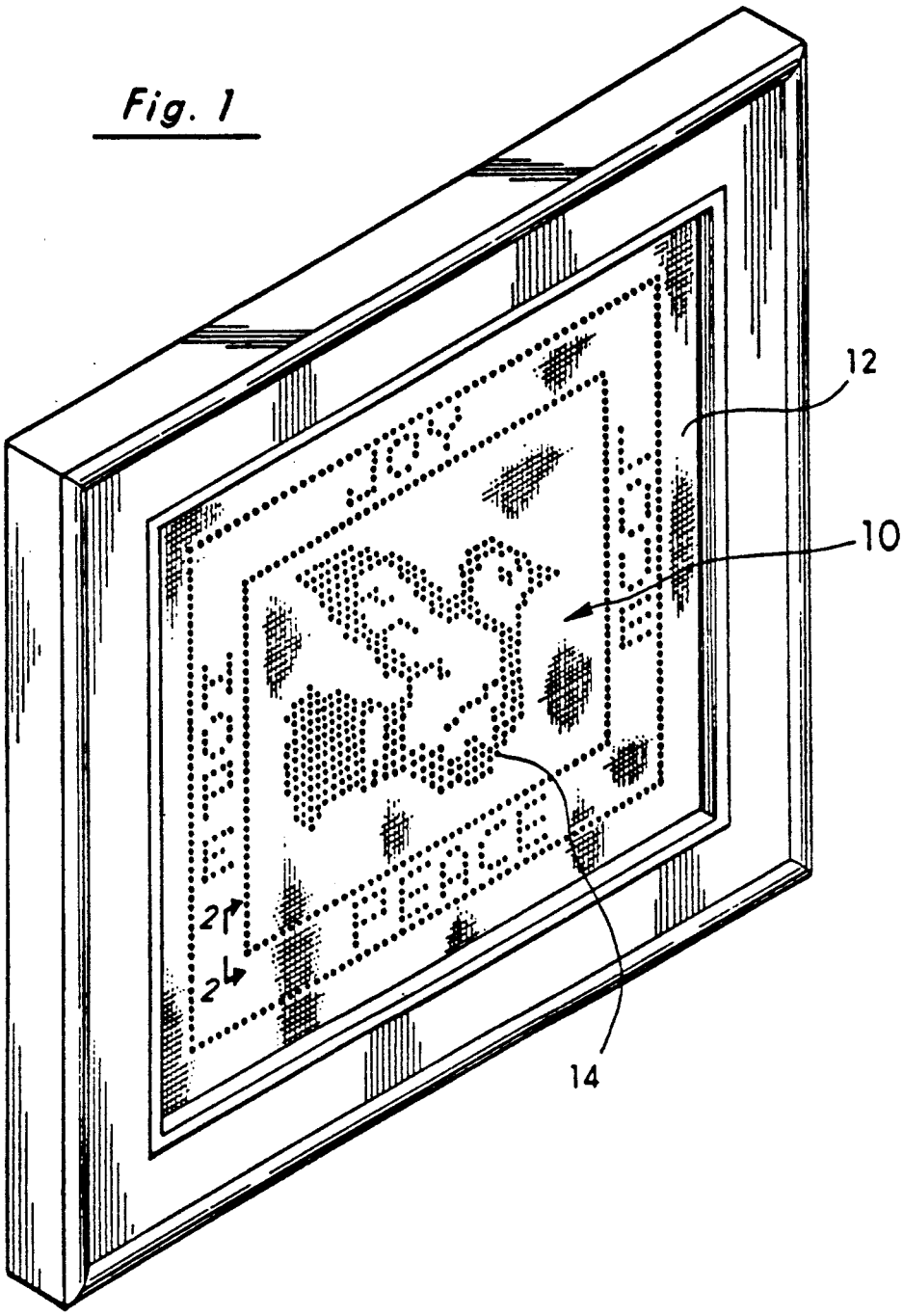
FIG. 1 is a perspective view of a design created by a craft paint applicator.
Figure 2:
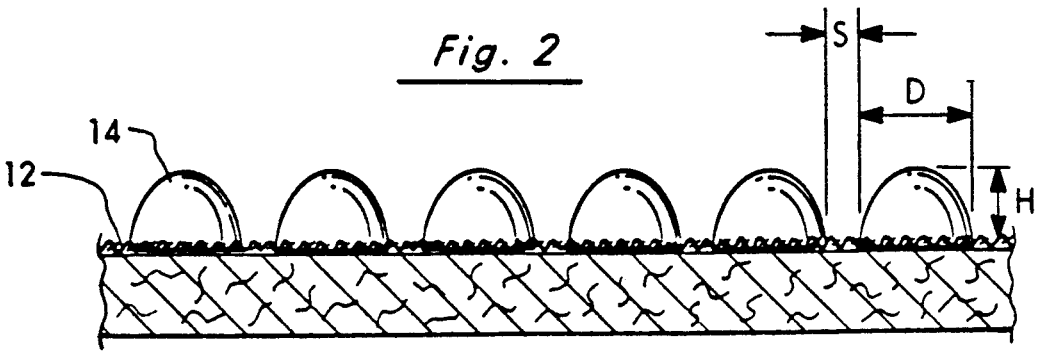
FIG. 2 is a cross-sectional view of the beads of the design of FIG. 1 along lines 2—2.
Figure 3:
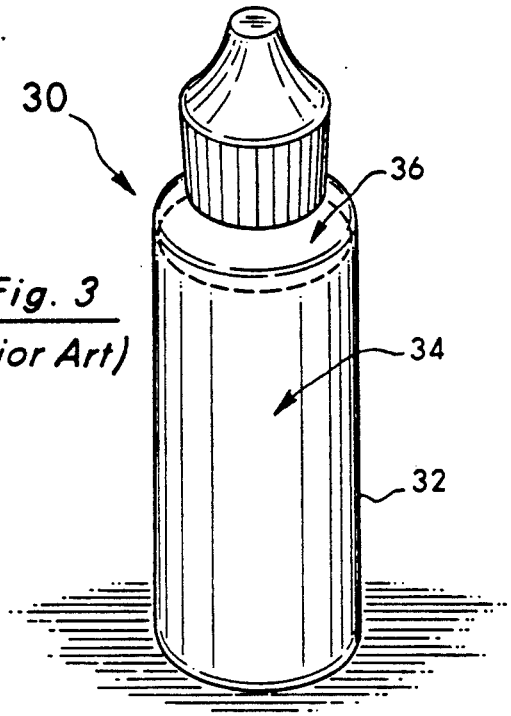
Fig. 3 (Prior Art)
FIG. 3 is a perspective view of a prior art craft paint applicator.
Figure 4:
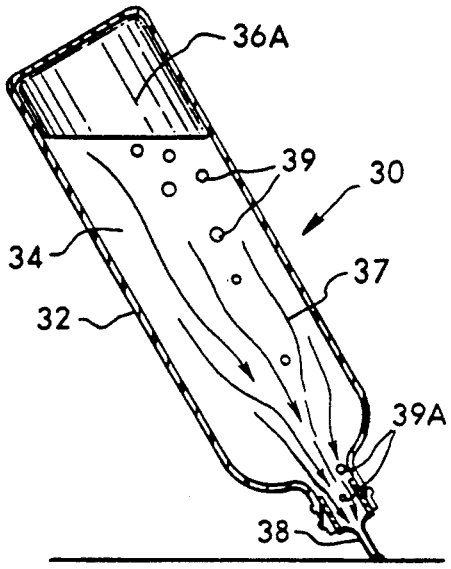
Fig. 4 (Prior Art)
FIG. 4 is an inverted, cut-away view of the prior art applicator depicted in FIG. 3.
Figure 5:
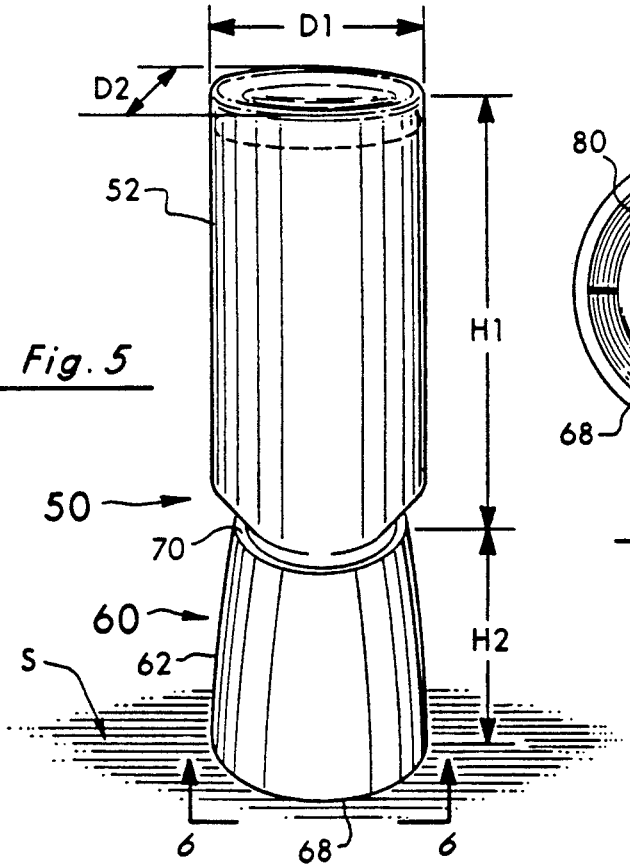
FIG. 5 is a perspective view of a preferred embodiment of the holder of the present invention.

The present invention provides a holder with a cap portion for craft paint applicators to eliminator or minimize the problems with air bubbles in the craft paint flow and drying of craft paint within the craft paint applicator tip. A preferred embodiment of this invention is illustrated in FIGS. 5–8. It is to be expressly understood that the sealing cap of the present invention is not limited to the descriptive use on a craft paint applicator but includes other applications and embodiments within the scope of the present inventive concept.

Applicator 50, shown in FIGS. 5–8, includes applicator bottle 52 having a threaded portion 56 and an abutment shoulder 55 spaced from threaded portion 56. Applicator tip 54 is secured onto applicator bottle 52. Applicator tip 54 includes circular surface portion 53 and dispensing end 58 spaced from abutment shoulder 55 by a length "1". The dispensing end 58 in the preferred use is a fine tip having a sidewall thickness in the range of about 10 to 20 mils and a dispensing end surface outside diameter in the range of about 40 to 60 mils.

2. Inverted Cap 60 Exterior Construction

Figure 6:
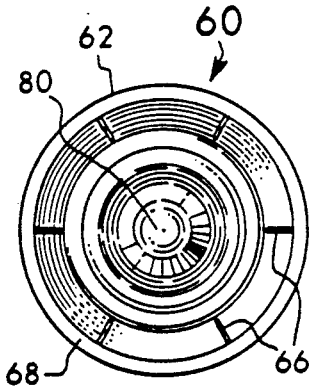
FIG. 6 is an end view of the holder of FIG. 5.

Holder 60, shown in FIGS. 5–8, includes a frustoconical shape having an exterior wall portion 62 and inner sidewalls 64. Ribs 66, shown in FIG. 6, are spaced around the inner surface of exterior wall portion 62 to provide stiffening to strengthen cap holder 60 and also to prevent the holders from nesting together during the manufacturing process. The lower end of exterior portion 62 of cap holder 60 forms a circular base 68 to support cap holder 60 on a surface S. In the preferred embodiment, circular base 68 has a diameter substantially equal to the largest diameter D1, illustrated in FIG. 5, of the oval shaped applicator bottle 52. In the preferred embodiment, the diameter of the top 70 of cap holder 60 is greater than the smaller diameter D2 of the oval applicator and smaller than the diameter of the base 68.

The cap is of molded construction and is a one-piece integral structure. In the preferred embodiment, the total height, $H_T$, equals the sum of heights $H_1$ and $H_2$. In the preferred embodiment, the ratio of $H_1$:$H_2$ is about 2:1 (varying in the range of 1.8:1 to 2.2:1), the ratio of $H_T$:D2 is about 3.6:1 (varying in the range of 3.2:1 to 4.0:1) and the ratio of $H_1$:$D_1$ is about 1.2:1 (where the ratio is $>1$:1). These ratios are important to provide stability with the cap (i.e., holding the applicator in a vertical position without tipping) to the system of the present invention especially when the system is used in a temporary working position as described later.

3. Inverted Cap Interior Construction

Figure 8:
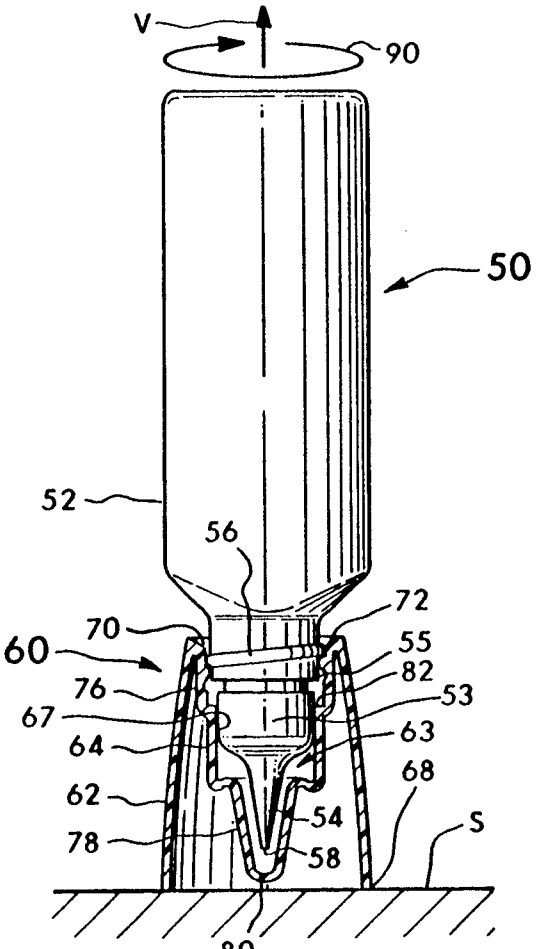
FIG. 8 is a cross-sectional view of the holder of FIG. 7 with the applicator in a temporary working position.
Figure 7:
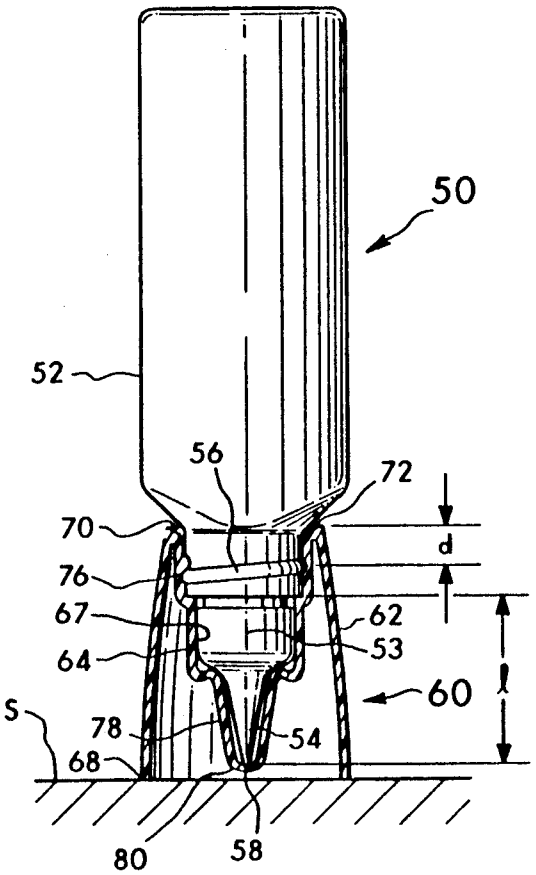
FIG. 7 is a cross-sectional view of the holder of FIG. 5 fully locked onto an applicator.

The upper circular end 70, shown in FIGS. 7 and 8, of holder 60 includes an interior portion 72 forming a cap portion which extends downward into a formed interior cavity 63 formed by sidewalls 64. Interior portion 72 has formed threads 76 on sidewalls 64 commencing a distance "d" from upper end 70 for mating engagement with threads 56 of applicator bottle 52. In the preferred embodiment the threaded portion 76 of cap holder 60 and threads 56 of applicator 50 fully engage and lock in about one and a quarter turns for a quick "twist-lock" connection.

Interior portion 72 includes a tapered region 78 formed in sidewalls 64 extending downward from threads 76 and terminating in an end wall 80. In the preferred embodiment, the sidewalls 64 also includes a formed abutment shoulder 82 spaced a distance "1" from end wall 80. Abutment shoulder 82 engages an abutment shoulder 55 on applicator 50 to form a seal when the cap 60 is fully twisted on as shown in FIG. 7. Interior portion 72 also includes tubular surface 67 spaced from abutment shoulder 82 for engagement with surface 53 of applicator tip 54. Dispensing end 58 of applicator tip 54 is also spaced from abutment shoulder 55 about the distance "1". This ensures that end wall 80 seals dispensing end 58 as abutment shoulder 82 engages abutment shoulder 55. Thus, dispensing end 58 is sealed from air circulation by the engagement of the abutment shoulders and end wall 80. Dispensing end 58 is also sealed from leaking by end wall 80. Interior portion 72 thus forms interior cavity 63 which is an effective cap for sealing applicator 50 from drying and from leakage. Applicator tip 54 is inserted into interior portion 72 and locked into place by the engagement of the threads 56 and 76. The dimensions of the applicator 50 and cap 60 are approximately those shown in FIGS. 7 and 8. It is to be expressly understood that the present invention is not meant to be limited to the described sealing technique but includes other types of seals as well.

4. Storage of Applicator 50 on Inverted Cap 60

Applicator 50 is always maintained in an inverted position by holder 60 when sold, used and stored. The craft paint is kept in fluid contact with the inner surfaces of the applicator tip by gravity flow. This prevents the formation of air pockets between the craft paint and the applicator tip. The formation of air bubbles in the craft paint are thus minimized if not eliminated. Another important benefit from the inverted position of the applicator is the prevention of air circulation within the dispensing end. Since the fluid craft paint is always in contact with the inner surfaces of the applicator tip, there is no opportunity for air to circulate within the dispensing end 58 of the applicator tip. This eliminates any drying of craft paint within the applicator tip and the problems associated therewith are not present.

The inverted position of applicator 60 ensures that the applicator is always in a ready-to-use position. Since the craft paint is always in contact with the applicator tip, there is no need to wait for the craft paint to flow downward as in the prior applicators. Also, the user does not need to wait for air bubbles to dissipate in the craft paint, since there are no air bubbles present. This allows a much faster and more efficient application process to speed the creation of a stylized design.

5. Temporary Working Position of Applicator 50 on Cap Holder 60:

Holder 60 can also be used as a temporary working holder as shown in FIG. 8. The user of the applicator temporarily places the applicator in the cap between uses. While this position is not as effective in sealing the applicator tip from leakage and drying as the storage position described above for FIG. 7, it is convenient for temporarily storing the applicator momentarily during the application process, particularly when a plurality of applicators are being used. Applicator tip 54 is inserted in interior portion 72 until the initial part of threads 76 engages the upper portion of threads 56. The distance "d" is the distance that the dispensing end is held above the end wall 80 and is sufficient to ensure that applicator 50 will be relatively stable without fully locking applicator 50 in holder 60 by engaging the threaded portions. Applicator 50 can be quickly seated in holder 60 by a one-handed operation. This arrangement is not as stable as the fully locked position illustrated in FIG. 7 but allows a quick, one-handed operation for temporary storage during the application process.

The distance "d" in FIG. 7 is of sufficient length to allow the applicator 50 to be held in a vertical alignment V in holder 60. The weight of the applicator 60 and the remaining craft paint contained therein holds the beginning threads 56 and 76 in abutting relationship with each other. Likewise, cylindrical regions 53 and 67 are partially engaging and overlapping so as to not only add to the vertical alignment but also to impede or restrict airflow from entering the remainder of the inner cavity 63. The inner cavity 63 maintains a certain level of humidity from the point in the dispensing end so as to help prevent dryness. The paint has a level of viscosity which prevents paint from leaking during temporary storage. In either arrangement, applicator 50 is always in a ready-to-use position without the need to wait for the paint to flow downward and air bubbles to dissipate.

The present invention is thus able to provide a holder for craft paint applicators that maintains the applicator in a stable, ready-to-use position while minimizing air bubbles in the craft paint and drying of the craft paint. This allows the user to quickly create an elegant, stylized design by applying the craft paint in discrete beads with little effort.

The present invention is not meant to be limited by the description of the above exemplary embodiment. The configuration of the holder of the present invention encompasses other embodiments and variations as well, as applied in a number of differing applications within the scope of the present inventive concept.

We claim:

1. An apparatus for securely holding a craft paint applicator containing craft paint in an inverted position during storage and during use to minimize the formation of air bubbles in the craft paint and to minimize the drying of the craft paint in a dispensing end of the craft paint applicator, said apparatus comprising:

a holder for engaging and holding the craft paint applicator in said inverted position during said storage and during said use;

means on said holder for holding the craft paint applicator in a temporary working position and in said inverted position during said use to minimize said formation of said air bubbles in said dispensing end, said craft paint being held in contact against the inside of the dispensing end of the craft paint applicator, wherein said means for holding in a temporary working position allows said craft paint applicator to be placed in and removed from said holder with one hand; and means on said holder for sealing during said storage of said craft paint applicator in said inverted position, said sealing means including means for abutting the dispensing end of the craft paint applicator to prevent leakage of said craft paint, to minimize said formation of said air bubbles and to minimize drying of said craft paint at said dispensing end during said storage, said dispensing end being held a predetermined distance above said abutting means while said craft paint applicator is in said temporary working position, whereby said craft paint applicator is easily placed in and removed from said holder using said means for temporarily holding during said use and said craft paint applicator is securely sealed and held in said holder using said means for sealing during said storage.

2. A craft paint applicator system for minimizing the formation of air bubbles in a craft paint applicator and for minimizing the drying of craft paint in and around an applicator tip of a craft paint applicator, said system comprising:

said craft paint applicator including:

(a) an oval shaped applicator bottle for containing said craft paint, said applicator bottle having a largest diameter D1 and a smaller diameter D2, (b) said applicator tip connected on said applicator bottle, said applicator tip having a dispensing end for dispensing said craft paint through said applicator tip from said applicator bottle;

(c) a threaded portion formed on said applicator bottle above said applicator tip;

a cap conforming in substantial shape to the shape of said applicator tip for sealing said dispensing end of said applicator tip; and a holder integrally formed around said cap for holding said craft paint applicator within said cap in a substantially vertical position with said applicator tip extending downward so that the craft paint in said applicator bottle flows downward against said applicator tip and any air contained in said applicator bottle stays against the end of said applicator bottle away from said applicator tip; said holder formed in a frustro-conical shape; said applicator bottle having a height H1 above said holder when said holder engages said applicator bottle, said holder having a height H2, the ratio H1:H2 of said applicator bottle height to said holder height being in the range of about 1.8:1 to about 2.2:1; said holder including:

(a) an enlarged base portion of said frustro-conical shape having a diameter substantially equal to the largest diameter D1 of said applicator bottle to provide stability in holding said craft paint applicator in said substantially vertical position; the ratio of the height H1 to the smaller diameter D2 of said applicator bottle, H1:D2, being in the range of about 3.2:1 to about 4.0:1; the ratio of the height H1 to the largest diameter D1, H1:D1, is greater than about 1:1, (b) an upper portion of said frustro-conical shape located above said cap;

(c) an interior cavity formed in said upper portion and extending downwardly therein;

(d) a threaded portion formed in said interior cavity for engagement with said threaded portion on said applicator bottle;

(e) a first upper region on said threaded portion of said interior cavity for supporting said applicator tip in said downwardly extending position for temporarily holding said craft paint applicator in said substantially vertical position; and (f) a second lower region on said threaded portion of said interior cavity for engaging said applicator tip in said downwardly extending position for storing said craft paint applicator in said substantially vertical position; and (g) said cap formed in said holder below said second lower region, said cap having an inner wall formed in said interior cavity for engaging said dispensing end of said applicator tip to prevent leakage of craft paint out of said craft paint applicator when in said substantially vertical position.

* * * * *